US005584195A

United States Patent [19]

Liu

[11] Patent Number: 5,584,195

[45] Date of Patent: Dec. 17, 1996

[54] WRIST WRITING INSTRUMENT

[76] Inventor: Si-Jiu Liu, 1306 Cooper St. #44, Edgewater Park, N.J. 08010

[21] Appl. No.: 199,495

[22] Filed: Feb. 22, 1994

[51] Int. Cl.[6] ..... A44C 13/00

[52] U.S. Cl. ..... 63/1.1; 63/9; 401/6; 401/131

[58] Field of Search ..... 63/1.1, 2, 3, 5.1, 63/9, 11, DIG. 3; 401/6, 131, 52, 195

[56] References Cited

U.S. PATENT DOCUMENTS

| | | | |
|---|---|---|---|
| 1,099,810 | 6/1914 | Mehrlust | 63/5.1 X |
| 1,950,960 | 6/1933 | Wisser | 120/9 |
| 2,266,942 | 12/1941 | Wallace | 63/1 |
| 2,911,950 | 11/1959 | Freeman | 120/42.4 |
| 4,162,754 | 7/1979 | Fleming | 401/195 |
| 4,580,919 | 4/1986 | Ambasz | 401/117 |
| 4,679,954 | 7/1987 | Ambasz | 401/117 |
| 4,729,686 | 3/1988 | Ambasz | 401/117 |

FOREIGN PATENT DOCUMENTS

| | | | |
|---|---|---|---|
| 1253384 | 1/1961 | France | 401/6 |
| 2525444 | 10/1983 | France | 63/1.1 |
| 2642476 | 3/1978 | Germany | 401/131 |

*Primary Examiner*—Jerry Redman

[57] ABSTRACT

A wrist writing instrument which can be conveniently carried on a wrist like a bracelet and writes as a regular pen, comprises two major parts: First, a partially reinforced flexible barrel or a partially sectionalized barrel (34), with a plurality of rigid tubular sections and a continuous reinforcing member on which the sections are serially connected and reinforced along one side of the barrel. The reinforcing member is a structure or of a material which is flexible laterally but substantially rigid under longitudinal stretch. The above barrel can only be bent towards the reinforced side, the flexible side, and can not be bent towards the other three sides, the stiff sides. Second, a stiffening means (44) which structurally has at least one bendable side and at least one non-bendable side, is inserted into and pivotally mounted in the barrel (34) for a releasable stiffening of the wrist writing instrument. Turning and positioning the bendable side of the stiffening means opposite to the flexible side of the barrel, the instrument as a whole becomes stiff and straight ready for writing; while turning again and positioning the bendable side facing the flexible side of the barrel, the instrument becomes flexible again and ready to form a bracelet. A flexible ink reservoir (50) inside the barrel (34) is held at the end thereof, whose writing tip retracts into the barrel automatically in the circular form, and extends out automatically in the straight form of the wrist writing instrument.

20 Claims, 5 Drawing Sheets

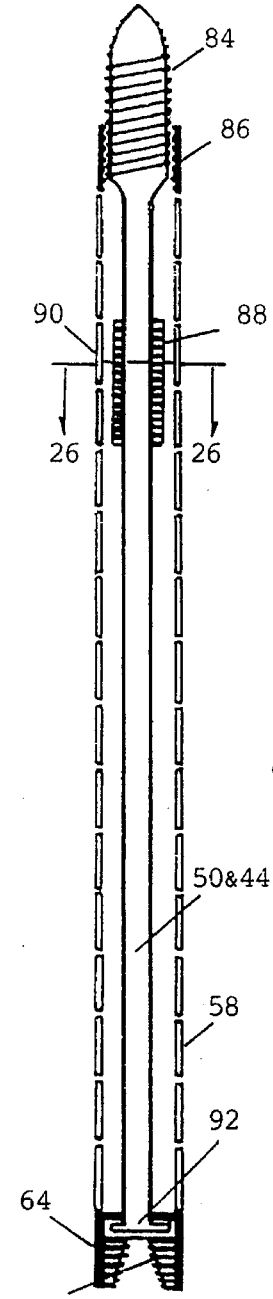
FIG.25
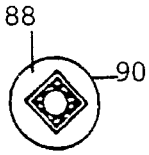
FIG.26
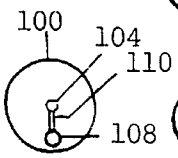
FIG.28
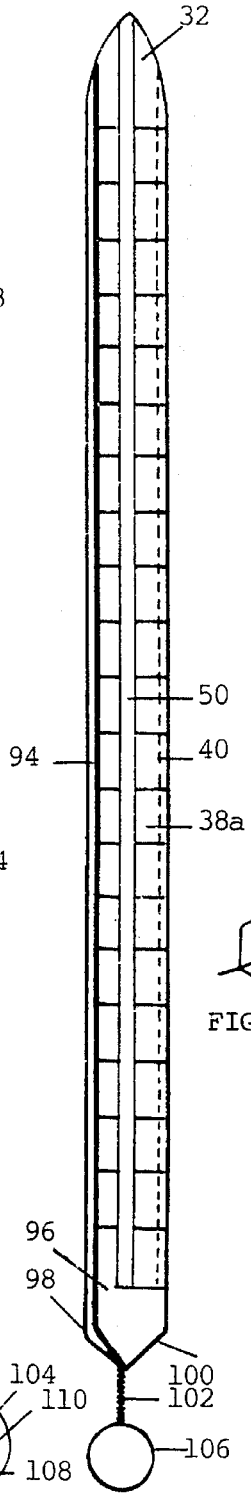
FIG.27
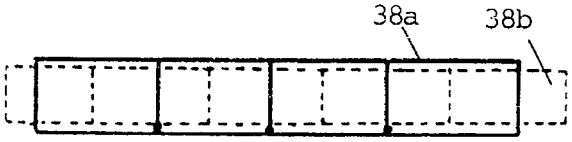
FIG.29-A
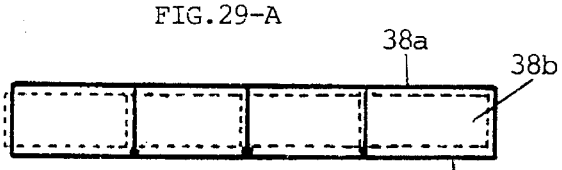
FIG.29-B
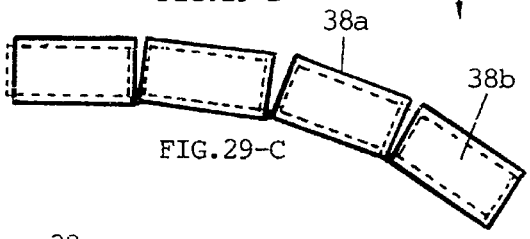
FIG.29-C
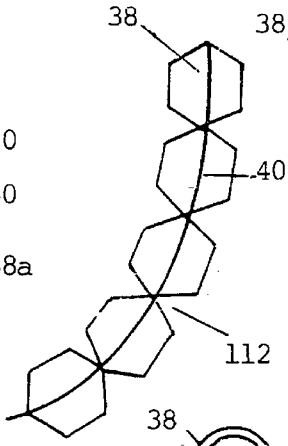
FIG.30-B3
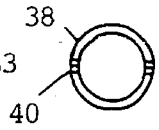
FIG.30-C
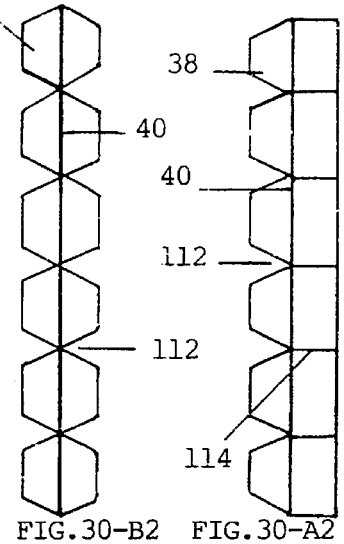
FIG.30-B2
FIG.30-A2
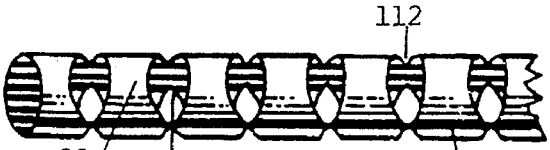
FIG.30-B1
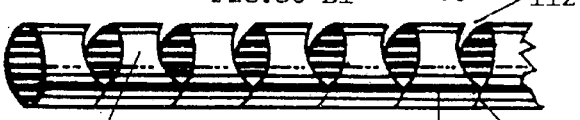
FIG.30-A1

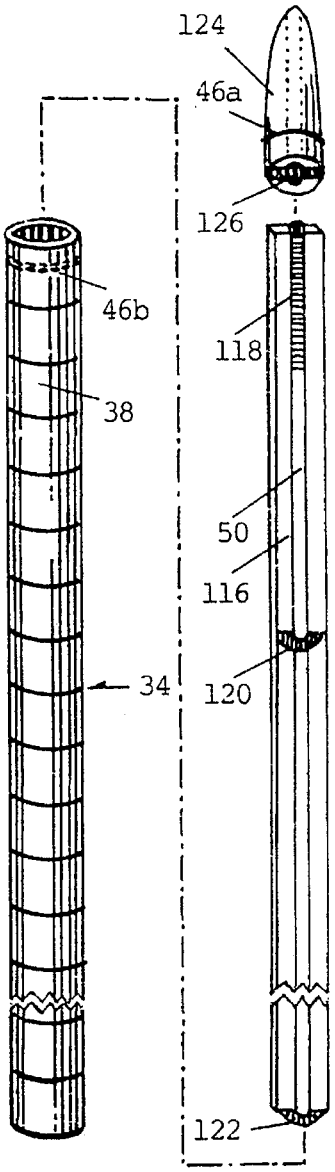
FIG.31
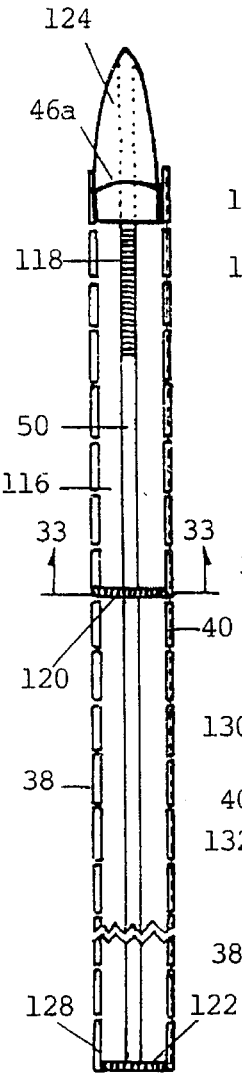
FIG.32
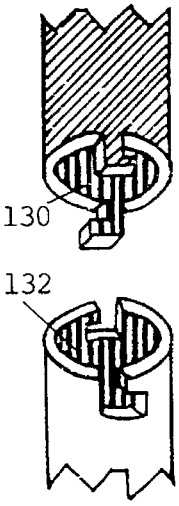
FIG.34-A
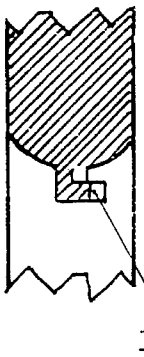
FIG.34-B
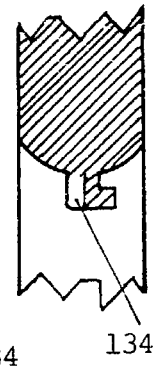
FIG.34-C
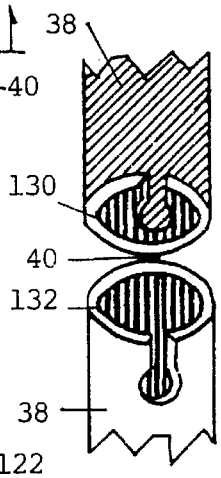
FIG.35-A
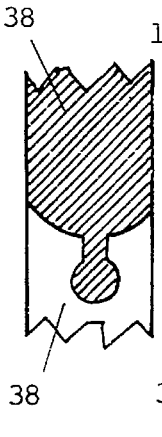
FIG.35-B
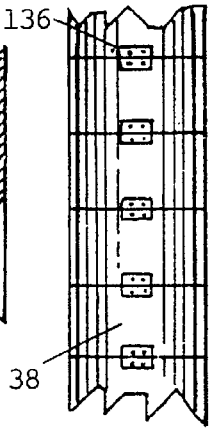
FIG.36
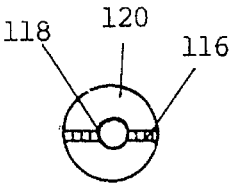
FIG.33
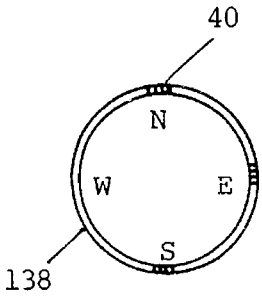
FIG.37-A
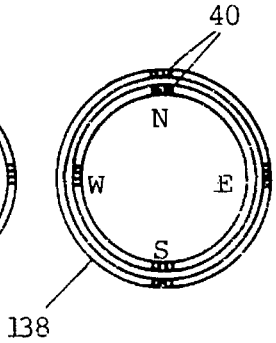
FIG.37-B
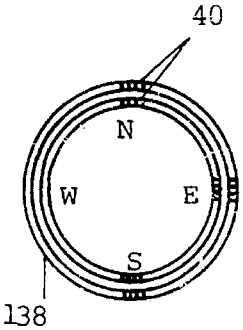
FIG.37-C

WRIST WRITING INSTRUMENT

BACKGROUND—FIELD OF INVENTION

This invention relates to a writing instrument, specifically to flexible ballpoint pen, that can be worn on a wrist.

BACKGROUND—DESCRIPTION OF PRIOR ART

We can not emphasize enough the benefits of having pens handy at all times. But the regular rigid pens are not particularly convenient to carry on a person, as most of the modern day sun, her clothing or indoor clothing are not designed for the convenience of carrying pens. They offer no or only a small pocket, which is not deep enough to fully accept a pen, especially those for ladies and sportsman. However, most people like to carry a pen anyway. When clipped to a shirt pocket or elsewhere, a pen can poke or press against the wearer from time to time. Moreover, a ballpoint pen tends to get lost. Students in particular have problem of losing pens.

Attempts have been made to combine a ballpoint pen with other item which people can wear every day. For example, U.S. Pat. No. 2,266,942 to Wallace, 1940 Oct. 24, discloses a bracelet in which a pencil unit is concealed. Another U.S. Pat. No. 4,162,754 to Fleming, filed 1977 Dec. 22, shows a watchband in which an ink reservoir of ballpoint pen is accommodated. Both above inventions require a stiffening material which is sufficiently rigid in a straight position and also sufficiently flexible to be bent and put on a wrist. Unfortunately, for materials like metal or plastic, if they are easily bent into a circular shape, they will not provide sufficient rigidity in a straight position; and if they are made stiff enough, they will not be easy to bend into a circle, unless one uses his full and great strength.

OBJECTS AND ADVANTAGES

Accordingly, the object of my invention is to provide a wrist writing instrument that is really easy to be made into a good circular form for its being conveniently worn on a wrist when not in use, while still easy to be stretched to a rigid and straight form for normal writing.

Another object is to provide a wrist writing instrument that does not rely on, or hide in a bracelet or a watchband, but rather performs all functions by its own.

Still a further object of the invention is to provide a wrist writing instrument, that is not only a good and normal writing implement but also a nice wrist decoration, at same time, or even a practical watchband.

DRAWINGS FIGURES

FIG. 25 is a plan view of a wrist pen with a beading type barrel.

FIG. 26 is a cross sectional view of the beading type barrel through line 26 in FIG. 25.

FIG. 27 is a plan view of the wrist pen with a tightening bar type stiffening means.

FIG. 28 is a bottom view of the wrist pen in FIG. 27, showing the parts that controlling the tightening bar.

FIG. 29 shows a few sections of the wrist pen, with the mechanism of half-way telescope stiffening means.

Figure 1:
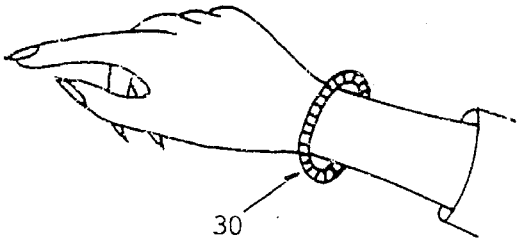
FIG. 1 shows an overall effect of a wrist pen worn on a wrist.

A—In half-way telescope position, the barrel of the pen is stiff;

B1—In full telescope position, the barrel of the pen is flexible, in bending as the arrow indicated;

B2—Curved barrel after bending of B1.

FIG. 30 $A_1$ and $B_1$ are perspective views, showing a part of the two partially reinforced flexible barrels with two reinforcing members respectively; $A_1$ with only one shoulder cut, $B_1$ with two shoulders cut. $A_2B_2B_3$ are side views for the same barrels of $A_1$ and $B_1$, showing the one-side ($A_2$) AND two-side ($B_2B_3$) flexible barrels; C shows the two reinforcing members at transverse section.

FIG. 31 is an exploded perspective view of a wrist pen with a strips type stiffening means.

FIG. 32 is a longitudinal sectional view of the wrist pen in FIG. 31, showing the assembly of the stiffening means and the pen barrel.

FIG. 33 is a transverse sectional view of the wrist pen through line 33 in FIG. 32, showing the ink reservoir with two strips wings.

FIG. 34 shows a part of two sections (A), that can be stiffened by matching two twist-type of toy-brick structures (B & C).

FIG. 35 shows two partial sections which are reinforced by the mechanical joints (A), and stiffened by matching two press-type toy-brick structures(B).

FIG. 36 is a front view of a partial barrel of the wrist pen which is reinforced by hinges along front side.

FIG. 37 is a cross sectional view of the non-sectional type barrels, A a single tube, B two sleeved tubes with 6 reinforcing members at all four sides, C two sleeved tubes with 6 reinforcing members at only three sides.

| List of Reference of Numerals In Drawings | |
|---|---|
| 30 | Overall effect of the wrist pen |
| 32 | Cartrige retainer |
| 33 | Threads |
| 34 | Partially reinforced flexible barrel |
| 36 | Head-tail connection means |
| 38a | Section of barrel |
| 38b | Section of barrel which used as stiffening means |
| 38 | Section of either 38a or 38b |
| 40a | Reinforcing member of a barrel |
| 40b | Reinforcing member of a barrel used as stiffening means |
| 40 | Reinforcing member of either 40a or 40b |
| 42a | Joint between two sections of barrels |
| 42b | Joint between two sections of barrel used as stiffening means |
| 42 | Joint between two sections either 42a or 42b |
| 44 | Stiffening means |
| 46 | Last section |
| 48a | Protrusive ring for coupling |
| 48b | Depressed ring for coupling |
| 49 | Small bead |
| 50 | Ink reservoir |
| 51 | Groove |
| 52 | Ink reservoir holder |
| 54 | Slim neck |
| 56 | Twisting section |
| 58 | Free section |
| 60 | Spring |
| 62 | Spring support rod |
| 64 | Snap-on section |
| 66 | Gripping point |
| 68 | Vestigial threads |
| 70 | Protrusinve end of section |
| 72 | Depressed end of section |
| 73 | Hole |
| 74 | Spring strap |
| 76 | Spring handle |
| 78 | Tip block |
| 80 | Hole for ink reservoir through |
| 82 | Turn of coil |
| 84 | Threaded cartridge |
| 86 | Nut section |
| 88 | Square reinforced part |
| 90 | Square centered section |
| 92 | Enlarged tail |
| 94 | Tightening bar |
| 96 | Smooth hole |
| 98 | Gripping section |
| 100 | Gripping plastic |
| 102 | Teeth on tightening bar |
| 104 | Gripping hole |
| 106 | Loop |
| 108 | Releasing hole |
| 110 | Releasing seam |
| 112 | Shoulder cut |

-continued

| List of Reference of Numerals In Drawings | |
|---|---|
| 114 | Seam (shoulder not cut) |
| 116 | Strip |
| 118 | Ink |
| 120 | Stabilizer |
| 122 | Cover |
| 124 | Cartridge |
| 126 | Slot |
| 128 | Rubber layer |
| 130 | Male end |
| 132 | Female end |
| 134 | Gap |
| 136 | Hinge |
| 138 | Non-sectional tubing |

DESCRIPTION OF INVENTION (FIRST EMBODIMENT)

Figure 3:
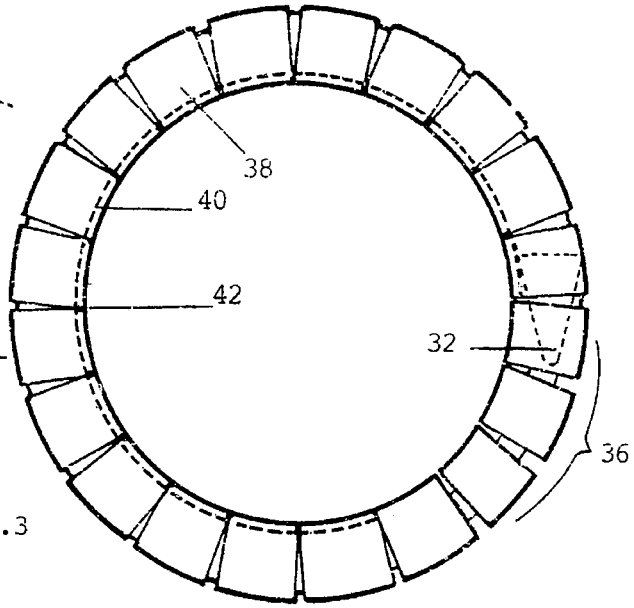
FIG. 3 is a plan view of the wrist pen in circular form.

Referring now to the drawings, the wrist writing instrument in this embodiment is a wrist ballpoint pen, or wrist pen, shown generally at 30 in FIG. 1. The wrist pen functions in two different forms: The straight form for writing, is shown in appearance in FIG. 2, comprising a cartridge retainer 32, a partially reinforced flexible barrel 34, and head-tail connection means 36. The circular form of the wrist pen for its being conveniently carried on wrist when not in use, and for decorating the wrist as well, is shown in FIG. 3. The interior parts of the pen and the connections will be shown in the rest figures.

Barrel of the wrist pen

Figure 4:
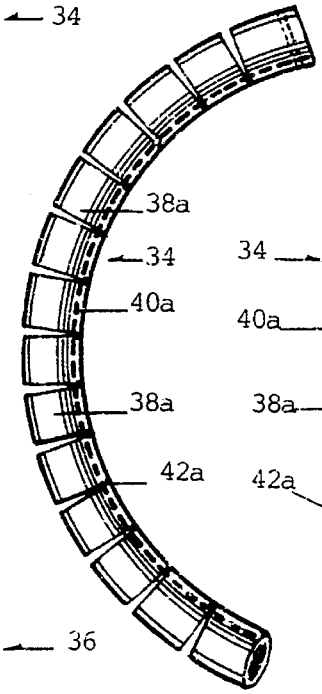
FIG. 4 is a side perspective view of a partially reinforced flexible barrel, reinforced at right side of the barrel.
Figure 5:
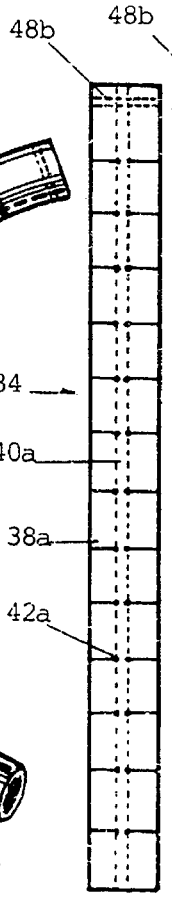
FIG. 5 is a plan view of the same partially reinforced flexible barrel in FIG. 4, showing a reinforcing member on which the sections are connected.

Partially reinforced flexible barrel 34 is such a pen barrel that can be bent towards at least one side of the barrel freely, in order to form a circle or to stretch again into a straight pen. The flexibility, in this embodiment, results from sectionalization of the barrel; concretely, partially reinforced flexible barrel 34 comprises a plurality of rigid tubular sections **38*a*, and a reinforcing member 40*a*, on which the sections 38*a* are serially connected along one side of the sections (for instance, the right side in FIG. 4). This connection also forms a series joints 42*a* along the side (FIG. 5). The reinforcing member of material is flexible laterally but substantially rigid under longitudinal tension. Therefore, the partially reinforced flexible barrel 34 has only one flexible side, that is the side reinforced. A circular form of the wrist pen can be curved towards this flexible side. On the other hand, the partially reinforced flexible barrel is substantially stiff towards other sides, the stiff sides, because the sections are rigid and the reinforcing member 40*a*** bears the tension (moment of force) when bending away from it.

There are many ways to connect reinforcing member **40*a* and the sections 38*a*** by virtue either of the extrusion of liquid plastic (which will form the sections) directly onto the reinforcing member, or the application of heat of adhesive. If the sections and the reinforcing member are made of the same material, molding is the best way, as the whole set of the barrel is molded into one piece. Mechanical methods such as the hinges, bolts, and a variety of fasteners can also connect the sections together and reinforce the sectionalized barrel. In order to ensure the really stiff pen barrel, the partially reinforced flexible barrel should not be made absolutely straight when stretching; a nearly straight barrel is squeezed tighter in forming a stiff and straight wrist pen.

Stiffening means

Figure 7:
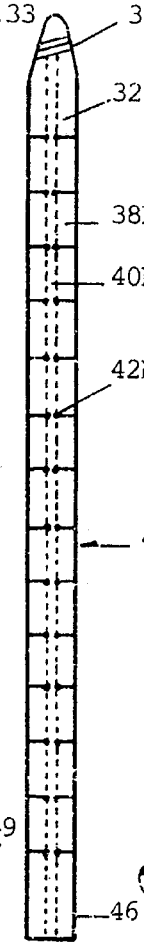
FIG. 7 is a front view of the same partially reinforced flexible barrel in FIG. 6, showing a reinforcing member.
Figure 6:
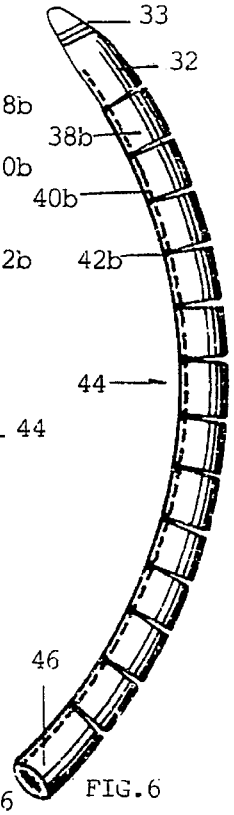
FIG. 6 is a side perspective view of a partially reinforced flexible barrel, reinforced at left side of the barrel and is used as a stiffening means.

Stiffening means 44 is for pressing or squeezing partially reinforced flexible barrel 34 and its sections **38*a*, and thus preventing the sections from loosening apart and the barrel from bending. So as to keep the wrist pen stiff and straight. There are many different structures that can serve as stiffening means in other embodiments of the invention (see ramification below). In this embodiment, stiffening means 44 is structurally a second partially reinforced flexible barrel, which is similar with, and inserted into the first one described above. The stiffening means also comprises a plurality of rigid tubular sections 38***b*, and a reinforcing member 40*b*, on which the sections are serially connected along one side of the sections(left side in FIG. 6). This connection also forms a series of joints 42*b* at the side (FIG. 7). Reinforcing member 40*b*, which is flexible but not elastic, enables stiffening means 44 substantially stiff towards all sides of the barrel except the reinforced side (left side in FIG. 6 & 8). Therefore, the stiffening means also has both flexible side and stiff sides.

Assembly and functions

Figure 8:
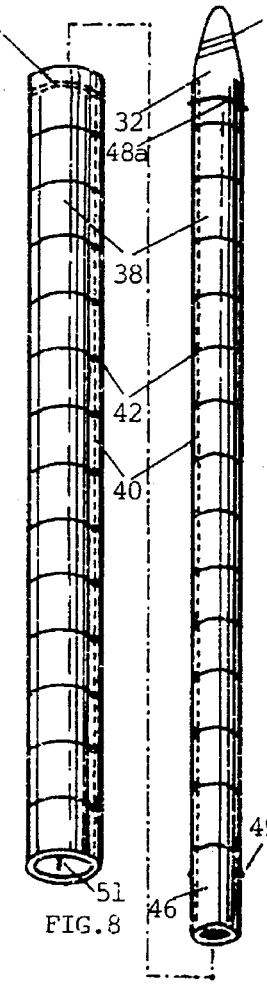
FIG. 8 is an exploded view showing a partially reinforced flexible barrel, used as a stiffening means, should be inserted into another partially reinforced flexible barrel.

When the stiffening means 44 is inserted into the pen barrel, the partially reinforced flexible barrel 34, as shown in FIG. 8, none of the two (one-side) flexible barrels is flexible again. In other words, a stiff and straight wrist pen is thus constructed. The reason for the magic result is obvious in FIG. 9: the two reinforcing members 40*a* & 40*b*, which are located in opposite sides (left and right side) squeezing with each other and restrict bendings towards both right and left, so as to keep the pen rigid and straight. Moreover, bendings towards back and forth directions are also arrested. Although the arm of force in the back and forth directions (½ diameter of the barrel) is only a half of that in the left and right directions (full diameter), two reinforcing members 40*a* & 40*b* together bear the tension force, because the moment of force is the product of the force times the arm of force. Therefore, in all the above four directions, also the directions in their between, the products are equal.

When stiffening means 44 is twisted 180 degrees, adjusting the two reinforcing members 40*a* & 40*b* to the same side and releasing the squeezing force, the pen becomes flexible. Another 180 degrees of twisting will change the flexible form into the stiff and straight form again. Thus, half a circle of turning is enough to change the wrist pen from one form to another. This is one of the important advantages of the invention.

Figure 9:
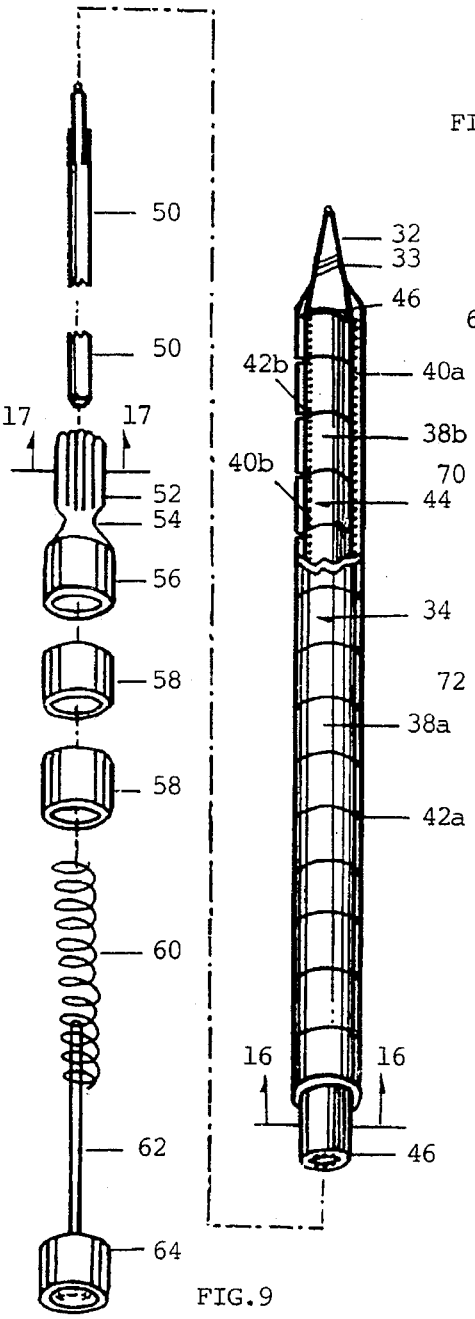
FIG. 9 shows an exploded view of two sleeved partially reinforced flexible barrels with some parts broken away, and the parts of a head-tail connection means.

With regard to the pivotal mounting of the stiffening means 44 in the barrel of the wrist pen, FIG. 9 & 8 show the details: a protrusive ring 48*a* on the stiffening means 44 is coupled with a depressed ring 48*b* on the barrel 34. This coupling allows them free turning without falling apart from each other. In order to ensure the turning or twisting smooth and effective, all parts must be made smooth and fit with each other. Also in order to hear or feel where the right place of the half a circle (180 degrees) is, two small beads 49 (FIG. 8) are made on the last section 46 for click coupling at least one groove 51 (FIG. 8) on the inner wall of the flexible barrel 34. An alternative is to make markers at corresponding positions to show the right place.

Extension Retraction

Figure 2:
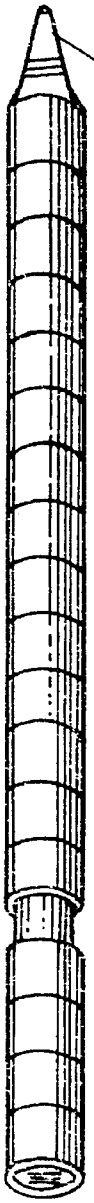
FIG. 2 is a perspective view of the wrist pen in straight form.

Only a small portion of last section 46 is sleeved inside the pen in FIG. 9; and the rest portion will be retracted into the pen when it is bent into circular form (FIG. 3), and extended out again when it is stretched into straight form (FIG. 2).

Two sleeved barrels 34 & 44 in circle form have a common center of the circle, but different circumferences due to the different radius. The radius for stiffening means 44 is a little bit longer than that of the pen barrel 34. The difference is one thickness of the sectional wall. The following formula is used for calculating the distance needed for the extension-retraction:

$$\begin{aligned} D &= 2\pi(R+T)\times X°/360° - 2\pi R\times X°/360° \\ &= (2\pi R + 2\pi T - 2\pi T - 2\pi R)\times X°/360° \\ &= 2\pi T\times X°/360° \end{aligned}$$

D—Distance needed for extension-retraction

π—Circumference ratio

R—Radius for the barrel 34 in circle form

T—Thickness of the wall of sections

X°—Actual degree of the wrist X° occupied in the circle

Example: suppose T=1 mm, and x°=270° degree $$\begin{aligned} D &= 2\pi\times 1\text{ mm}\times 270°/360° \\ &= 2\times 3.1416\times 1\text{ mm}\times 3/4 \\ &= 4.7\text{ mm} \end{aligned}$$

So the distance needed for extension-retraction of the last section 46 is 4.7 mm.

The protrusive ring 48*a* can also be made on last section 46 so that the, cartridge retainer 32 can extend and retract. This may even be a better option for another embodiment of the invention. Most of the modern mechanical ballpoint pens extend-retract from their cartridge end. Although cartridge retainer 32 in FIG. 9 does not extend-retract, the ink reservoir with its ballpoint does (from the hole of the cartridge retainer). The calculation for the ink reservoir's extension-retraction can be based on the same formula given above with a minor modification; T should represent two thicknesses of the sectional wall instead of one, because the ink reservoir is inserted inside the double barrels. Therefore, the extension-retraction with either end are automatic without additional parts. This is another important advantage of the invention.

Head-Tail Connection means

Head- tail connection means 36 in this embodiment is a set of extra sections, that are designed to connect the two extremities of the wrist pen and to form a circular form. However, in some embodiments of my invention, an open-circle form of the wrist pen have been designed that without a head-tail connection means. Both closed and open circular forms are convenient in wearing. Therefore, head-tail connection means is not necessarily an essential part of the invention. As a fully described embodiment here I choose to describe the closed circle form first. FIG. 2 & 3 show an overall appearance of the connection means. FIG. 9 shows an exploded view for the individual parts. Ink reservoir holder 52, on which the ink reservoir 50 is frictionally fixed, is inserted into last section 46 of the stiffening means 44 releasably and firmly.

Figure 15:
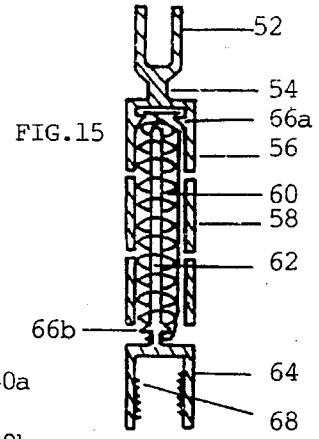
FIG. 15 is a sectional view of the head-tail connection means and its assembly.
Figure 16:
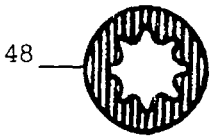
FIG. 16 is a transverse sectional view of a last section and its inner wall structure through line 16 in FIG. 9.
Figure 17:
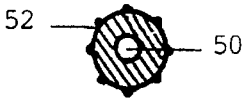
FIG. 17 is a transverse section view of the ink reservoir holder through line 17 in FIG. 9.

Linked by a slim neck 54, ink reservoir holder 52 is a part of a turning section 56, With which the stiffening means 44 is turned. In order to ensure the instant response to the turn, some longitudinal ribs are made on the surface of the holder 52 and the inner wall of last section 46, as shown in FIG. 16 and FIG. 17 through lines 16 & 17. There are a few free sections 58 for covering a spring 60 which provides elasticity for a hand to wear through the circle of the wrist pen. The last part of the connection means 36 is a snap section 64 and its tail, a spring support rod 62, which is inserted into spring 60. The whole assembly of the connection means is shown in FIG. 15. Inside of the turning section 56, at least 2–3 snap-on points 66*a* are made near the base of the inner wall, for the head of spring 60 to click on. Another set of snap on points 66*b* are made on the base of spring support rod 62 for the tail of the spring to click on. Thus, with spring 60, and the connection means 36 is strung up an elastic piece as a whole. On the inner wall of the snap section 64, there are vestigial female threads 68 to click snap, with a simple push, the threads 33 on the cartridge retainer to form a circular form (see FIG. 9). Since the resilience of the pen at the two ends connected, are mainly in centrifugal (not circumferential) direction in the circular form, the snap on connection is strong enough; however, if drive one or two turns of the snap section 64, it will further fasten the two ends of the wrist pen.

The spring support rod 62 and the slim neck 52 are slim enough or hollow in center, so that the whole set of head-tail connection means 36 is substantially flexible in making a good circular form of the wrist pen. For the same reason, the ink reservoir 50 should also made of a more flexible or softer plastic.

The above described connection means 36 is only an exemplification for this embodiment thereof. Many variations are possible. For example, besides using threads, a hook, a bolt or latch, a snap fastener, even a loop, etc. all can be used as a connection means.

Detail structure of the sections

Figure 13:
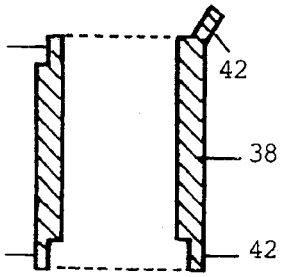
FIG. 13 is a sectional view of a single section through line 13 in FIG. 11, showing the joint part.
Figure 14:
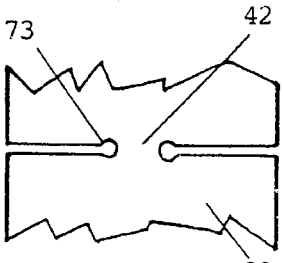
FIG. 14 is an amplified front view of a joint in FIG. 5 and 7, showing two small round holes besides a joint.
Figure 12:
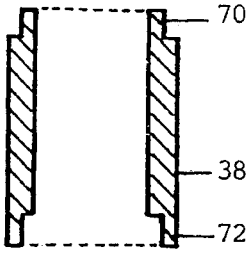
FIG. 12 is a sectional view of a single section through line 12 in FIG. 11, showing the protrusive and depressed edges.
Figure 11:
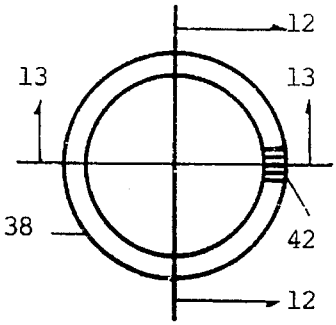
FIG. 11 is a top view of a single section showing the joint part and the protrusive and depressed ends.
Figure 10:
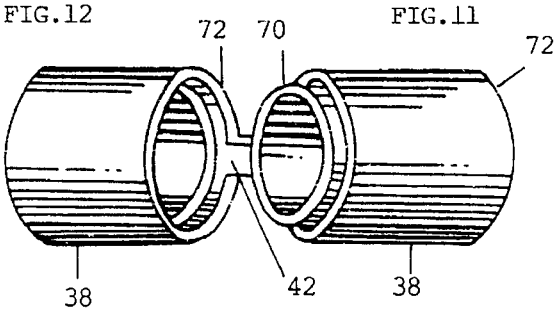
FIG. 10 is a perspective view of two sections, showing the two ends and joint.

The detail structures of the sections 38 are best shown in FIG. 10. Each section has two different ends: a protrusive end 70 and a depressed end 72, which matches another protrusive end of the next section, so that all the sections 38 in a barrel are properly matched. FIG. 11 is a top view of a single section, showing that the protrusive or depressed part is only a half of the walls thickness. FIGS. 12 & 13 are sectional views from lines 12 where there is no joint, and line 13 where there is a joint 42, which is in fact a part of the next section. FIG. 14 shows an amplified side view of a partial section 38, indicating two small round holes 73 besides a joint 42. The holes provide a smooth and round edges for the joint to avoid breakage.

Operation of the Invention

Interchange between stiff and flexible and between straight and circular forms of the wrist pen, is fulfilled by operating the stiffening means against the barrel of the pen. From the straight form to a closed circle form: hold the pen with left hand, and turn the turning section 56 for 180 degrees until feel or hear a click; the rigid pen becomes flexible and curved in appearance. Then, hold cartridge retainer 32 with one hand, and the snap section 64 with another, and give a firm push, until hear a click; or drive the snap section for one or two turns, the curved pen becomes a closed circular form.

From circular to straight form: unscrew the snap section 64, the pen restores its curved appearance, hold the pen with left hand, and press or stretch the curved pen to almost straight, then turn the turning section 56 for another 180 degree until hear a click, the pen becomes straight form again with the ball point extending out automatically. To replace a new ink reservoir: pull out the twisting section 56 and the ink reservoir holder 52 from the last section 46, and discard the old ink reservoir and insert a new one. Eventually, the wrist pen can be sold as a disposable pen, because of the easy assembly (just a insertion) and low cost (all by molding).

Ramification And Scope of Invention

Embodiment 2—Spring strap type

1) BARREL OF THE PEN

Use the partially reinforced flexible barrel as in the first embodiment.

2) STIFFENING MEANS

Figure 18:
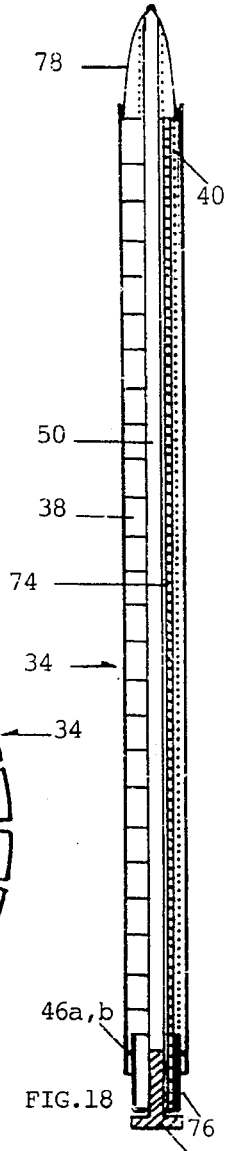
FIG. 18 is a wrist pen of spring strap type showing a stretched spring strap that keeps the pen straight.

In comparison with first embodiment, a new stiffening means is employed in this embodiment. Referring to FIG. 18, a stretched spring strap 74, as a new stiffening means is inserted into partially reinforced flexible barrel 34, which has a plurality of sections 38*a* and a reinforcing member 40*a* on the right side. The original shape of the spring strap 74 is an open circle with a spring handle 76 fixed on one end, and a tip block 78 on the other. Spring strap 74 is designed thicker or wider in the middle than on the two ends, such that it will be straight when fully stretched inside the wrist pen.

Figure 20:
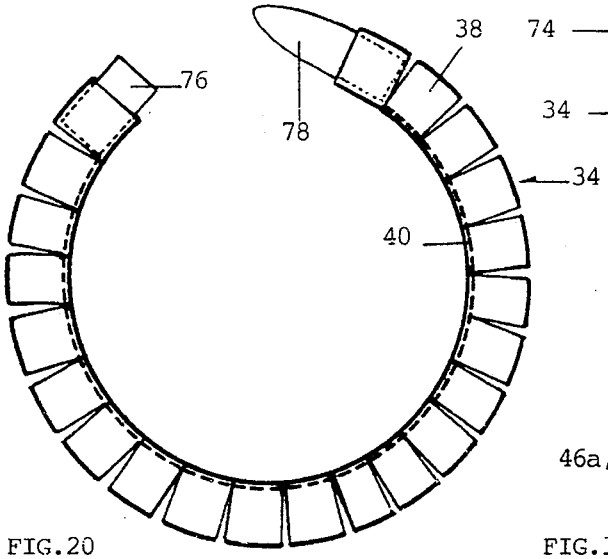
FIG. 20 is a side view of a wrist pen in open-circle form without a head-tail connection means.

The stretched spring strap 74 tends to curve to left side in FIG. 18 and press the sections towards left. However, since the sections themselves are rigid, the spring force can only keep the sections tight longitudinally and the pen straight. By turning the handle 76 (or the tip block 78), and placing the spring strap 74 to the left side (180 degree); the wrist pen will immediately curve and form a open circle under the force of spring, as shown in FIG. 20. By stretching the wrist pen to almost straight, at same time turning the handle 76 and placing the spring strap 74 to the right side again, the pen becomes rigid and straight again.

Figure 19:
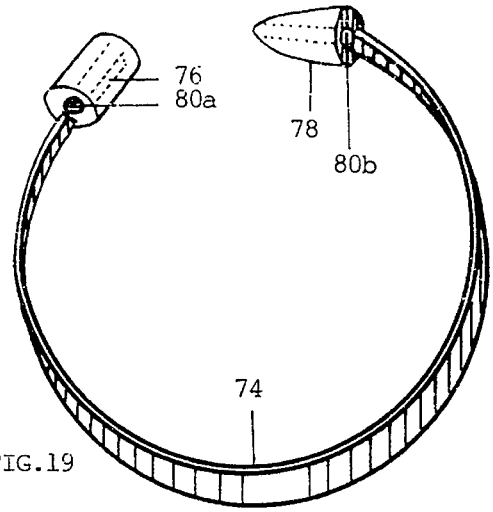
FIG. 19 is a perspective view of the spring strap with original shape before stretching.

Ink reservoir 50 is held by the holder 52 (FIG. 18) and inserted through a hole 80*a* on the handle 76 and another hole 80*b* on the tip block 78 (FIG. 18 & 19). Holder 52 is again held by the hole 80*a* frictionally. While tip block 78 is allowed to extend—retract freely, the handle 76 is pivotally mounted by the coupling of protrusive and depressed rings 48*a* & 48*b*, and is not allowed to extend or retract. It is interesting that the ball point in this embodiment, will extend—retract independently from the tip block 78. The rotation speed of spring handle 76 should be controlled with certain friction to avoid curving too fast when turning.

If the ink reservoir 50 is made of spring plastic, on the spring strap 74 can be omitted and in that case, this embodiment may even be simpler and better.

3) HEAD-TAIL CONNECTION MEANS

There is no need to have such a means, because the spring strap 74 provides and maintains an open circle for the wrist pen.

Embodiment 3—Spiral type

1) BARREL OF THE PEN

Figure 21:
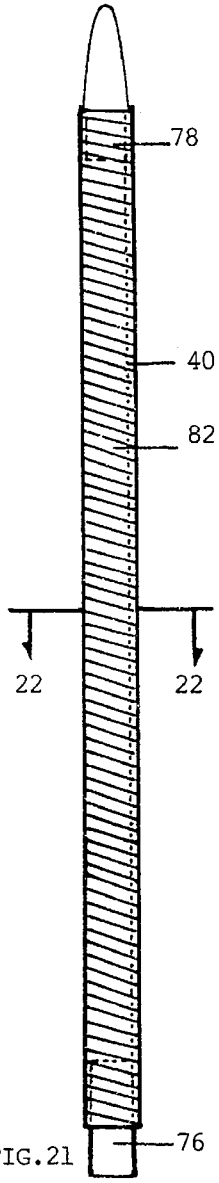
FIG. 21 is a plan view of a wrist pen with a coil type barrel.

Instead of the tubular sections, the partially reinforced flexible barrel in this embodiment is a spiral, comprising a plurality of turns 82, which are virtually coiled of a single long wire or plastic ribbon as shown in FIG. 21. Each turn of the barrel can be considered as a special short section which is made of rigid material such as hard plastic or metal, and in close contact with each other. Most importantly, a reinforcing member 40 is fixed longitudinally (by whatever means, thermoplastic or welding or glue) to one side of the coil barrel, so as to reinforce it into partially reinforced flexible barrel. The best spiral barrel may be made by molding plastic, in which the turns 82 and the reinforcing member 40 are all molded into one piece.

Figure 24:
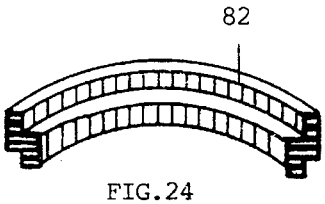
FIG. 24 is perspective view of a part of a coil turn, showing the protrusive & depressed edges.
Figure 22:
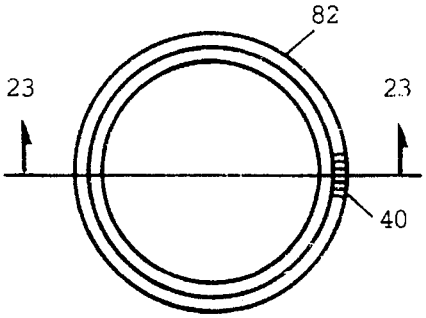
FIG. 22 is a cross sectional view of the coil type barrel through line 22 in FIG. 21, showing the reinforcing member at a joint.
Figure 23:
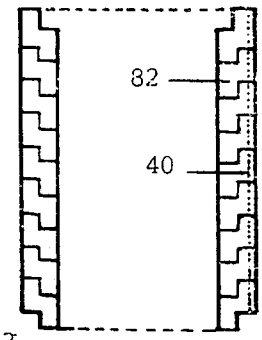
FIG. 23 is a sectional view of the coil type barrel through line 23 in FIG. 22, showing the protrusive and depressed edges.

In order to stabilize the spiral barrel, each turn should also contain the protrusive and depressed ends as shown in FIG. 22–24. FIG. 22 is a transverse view of the spiral barrel at the line 22 in FIG. 21, showing the reinforcing member and the joint 42. FIG. 23 is a sectional view of a part of the barrel at the line 23 in FIG. 22, showing the matched edges of the turns. FIG. 24 is a perspective view of a piece of the turn 82 and their edges.

2) STIFFENING MEANS

The stiffening means of the first or the second embodiment can be used. stiffening means in other embodiments below may also be adopted.

3) HEAD-TAIL CONNECTION MEANS

Optional according to the stiffening means used.

Embodiment 4—Beading type

1) BARREL OF THE PEN

The reinforcing member 40, in this embodiment, is an option. A plurality of beading-like free sections 58 with protrusive and depressed ends are strung on the ink reservoir 50 (FIG. 25). However, a reinforcing member fixed on the inner wall of the sections would stabilize the beading type barrel. Nevertheless this description will base on using free sections.

2) STIFFENING MEANS

In order to string the free sections 58, a substantially thicker ink reservoir 50 serves as a stiffening means. The tail of the reservoir is fixed to the last section of the beading. The tip of the reservoir is an enlarge, threaded cartridge, 84, which functions as a screw. By driving a nut section 86, all the free sections 58 are squeezed or pressed together tightly. The effective driving of the screw is ensured by a square reinforced part 88 on the ink reservoir, (FIG. 25 & 26), and a few square-centered sections 90, which prevent the reservoir from turning. An enlarged tail 92 is pivotally mounted on the snap section 64.

3) HEAD-TAIL CONNECTION MEANS

A snap section 64 functions as a connection means to snap on the threaded cartridge 84 when form a circle.

Embodiment 5—Tightening bar type

1) BARREL OF THE PEN

Use partially reinforced flexible barrel either tubular sections or spiral barrel.

2) STIFFENING MEANS

As shown in FIG. 27, a string or a flexible tightening bar 94, with one end fixed on cartridge retainer 32, and the other passed through a smooth hole 96, located opposite to the reinforcing member, leads to a gripping section 98. A gripping plastic 100 with a gripping hole 104 (FIG. 28) on the gripping section 98, grips some teeth 102 on the tightening bar 94. By pulling a loop 106 with finger will tighten the bar 94 and squeeze the sections 38*a* and therefore, cause the pen barrel stiff and straight for writing.

3) HEAD-TAIL CONNECTION MEANS

There is no need to have an extra connection means, to form a circular form of the wrist pen-in this embodiment. The tightening bar will do the job. Firstly, move the tightening bar 94 to a bigger releasing hole 108 through a releasing seam 110, both on the gripping plastic 100, showing in FIG. 28. Secondly, release and push back the tightening bar 94, which is substantial thick in diameter yet still flexible, and then move back to the gripping hole 104 again. The tightening bar 94 and the reinforcing member 40 together will keep the pen in open-circle form for wearing.

Embodiment 6—Half-way Telescope type

1) BARREL OF THE PEN

Use partially reinforced flexible barrel 34 as pen barrel.

2) STIFFENING MEANS

Stiffening means in this embodiment is a second partially reinforced flexible barrel inserted inside the pen barrel. FIG. 29 shows only four sections of the pen barrel. Sections of the two sleeved barrels have exactly the same length and fit well with each other. To stiffen and keep the barrel straight, push the stiffening means (the inner sections, indicated as dotted lines in FIG. 29A) from left to right, half the length of a section; the pen barrel then becomes stiff and straight immediately and ready for writing. To restore the flexibility, push back the sections with same distance, the pen becomes flexible again (see FIG. 29 B1 & B2).

This simple but remarkable function of the two sleeved barrels is explained as follows: every successive two sections of pen barrel (the outer one) are sleeved or held by one section of the stiffening means (the inner one) in between, when they are in half-way telescope position, so that they prevent each other from bending and keep the wrist pen stiff and straight.

There is another way to operate this embodiment by pushing half-way while turning 180 degree. This will provide stronger rigidity of the pen barrel, if two barrels both have a reinforcing member. Cartridge retainer 32 of this embodiment can be attached to either the pen barrel or the stiffening means.

3)HEAD-TAIL CONNECTION MEANS

Any connection means of other embodiments of the invention described above or below can be adopted.

Embodiment 7—Double reinforcing member type

1) BARREL OF THE PEN

In this embodiment, the pen barrel is also a partially reinforced flexible barrel, but instead of reinforcing from one side, the sections are reinforced from two opposite sides. Therefore, two reinforcing members 40 on one barrel are needed as shown in FIG. 30. Since the sections are rigid, bending towards any side is prevented, if there is no gap between the sections. However, if the shoulder parts 112 of the sections are cut away from one side of the sections (between the two reinforcing members), the barrel becomes flexible towards that side (see FIG. 30A1, the perspective view, and A2 the side view); if the shoulder parts 112 are cut away from both sides, the barrel is flexible towards both sides (see FIG. 30 B1, the perspective view and B2, B3, side views). FIG. 30C shows the locations of the two reinforcing members. What are shown are only part of the whole barrel.

2) STIFFENING MEANS

A variety of stiffening means described above or below are adoptable to this embodiment. Firstly, a barrel of the same type can be used as stiffening means (either one-side or two-side flexible) as shown in FIG. 30 A1, B1). By turning 90 degree of the stiffening means, the pen can be changed from one form to another easily. For instance, a spring strap, a tightening bar, or a flat plate (see below), etc. all are good stiffening means for the embodiment.

3) HEAD-TAIL CONNECTION MEANS

Optional according to the stiffening means elected.

Embodiment 8—Flat plate type

1) BARREL OF THE PEN

Any partially reinforced flexible barrel described above can be used for the embodiment.

2) STIFFENING MEANS

Referring to FIG. 31, the stiffening means is a ink reservoir with two strips or wings 116 on opposite sides. An alternative is to make a long flat container, in which the ink 118 is filled. A regular ink reservoir together with one or two separate flat plates inserted in the pen barrel is another option. So long as they are flexible to at least one side, but substantially stiff to their edges. At least two round plates or stabilizers 120 are strung and fixed on the ink reservoir and the strips. The one at the rear also serves as a cover 122 of the barrel.

A cartridge 124 with a slot 126 at the end, and some longitudinal crest lines (not shown) on the surface, is connected to the ink reservoir and the strips 116. Then the whole assembly is inserted into the partially reinforced flexible barrel as shown in FIG. 32. By turning the cartridge 124 and pointing one of the two edges of the strip to the reinforcing member 40; the wrist pen now is stiff and straight for writing. By twisting 90 degree and pointing the edges away from the reinforcing member, the pen becomes flexible again. The cartridge 124 is pivotally mounted on the inner wall of the pen barrel, with protrusive and depressed rings (46*a* and 46*b*) coupling. So the whole assembly will not fall out of the pen (see FIG. 31 & 32).

3) HEAD-TAIL CONNECTION MEANS

A thin rubber layer 128 is adhered to the inner wall of the last section of the barrel. The rubber layer 128 will be exposed when it is bent and the cover 122 retracted into the pen. To form a complete circle, push the cartridge 124 firmly into the last section; the rubber layer will hold the cartridge frictionally. The strip type is the simplest embodiment, that contains the least number of parts in the invention.

Embodiment 9—Toy-brick type

1) BARREL OF THE PEN

Like most other embodiments, the barrel of the wrist pen in this embodiment, comprises a plurality of rigid tubular sections with hollow center. The sections are either connected with reinforcing member 40 at one side, or strung and reinforced like a beading by a thick ink reservoir. FIG. 34 & 35 each shows only two sections of the barrels. In both cases, the strung barrels are flexible enough for bending into a circle before stiffening.

2) STIFFENING MEANS

A variety of toy-brick structures can be used as stiffening means for pressing, squeezing, or stiffening sections together and preventing them from loosing apart. FIG. 34 shows an example of twist type of toy-brick structure, on which each section has a male end 130 and a female end 132 (FIG. 34A). When the sections are strung and matched together, they are still loose and flexible (FIG. 34B) in the barrel. When they are twisted, the two kind of ends of the sections gripe with each other; the pen becomes stiff and straight. By releasing the gripped ends in reverse direction the pen restores flexible again (see FIG. 34C).

FIGS. 35A&B show an example of press type toy-brick structure. The sections of this type, are connected with a reinforcing member or by a series of mechanical joints. By bending the pen barrel away from the reinforcing member, all male and female ends are pressed to match together and the pen is stiff and straight. When the pen is bent towards the reinforcing member firmly, the matched ends break and the pen is flexible again.

3) HEAD-TAIL CONNECTION MEANS

The connection means described above can be used in this embodiment.

Embodiment 10—Hinge and Other Mechanical joint type

1) BARREL OF THE PEN

A hinge 136 or other mechanical joints can be used for connecting two successive sections. A series of these joints on a pen barrel,are practically the reinforcing members 40, because they are flexible laterally but rigid under longitudinal stretch. Thus a sectional flexible barrel reinforced by hinges or other mechanical joints, is also a partially reinforced flexible barrel. And such barrel is also characterized as one-side flexible barrel with similar functions when used as the barrel of the wrist pen. FIG. 36 shows a part of such a barrel.

2) STIFFENING MEANS

Any stiffening means described above is adoptable to this embodiment.

3) HEAD-TAIL CONNECTION MEANS

To elect a close or open circle for the wrist pen is optional in this embodiment. So is the connection means.

Embodiment 11—Non-Sectional barrel type

1) BARREL OF THE PEN

A soft flexible, non-sectional sleeve can be used to cover any sectionalized barrel, and provide a smooth appearance of the wrist pen.

On the other hand, a non-sectional flexible tube 138 that can be bent into a circle, can also be reconstructed into partially reinforced flexible barrel. In that case, the flexible tube 138 is reinforced by at least three reinforcing members 40*a*, 40*b*, 40*c*, at three different sides (say North, South, and East in FIG. 37A). As mentioned before that the reinforcing member 40 is non-elastic or tension resistant, the partially reinforced flexible tube 138 will have different flexibility at different sides. Bending to South, North, and West are restricted, while to East side is still flexible. Therefore, the partially reinforced flexible tube 138 has possessed of the similar character with other one-side flexible barrels.

2) STIFFENING MEANS

A variety of stiffening means described above can be adopted to this embodiment. For example, a second such partially reinforced flexible tube 138, is inserted into the first one, in other words, two sleeved tubings with six reinforcing members. When turning and distributing the six reinforcing members in all sides of the pen barrel as shown in FIG. 37B, the pen is substantially stiff to all sides. When turning and placing them in only three sides and leaving one side (West side in FIG. 37C) free, then the wrist pen is flexible towards East side only, and ready to form a circular form.

3) HEAD-TAIL CONNECTION MEANS

All connection means described in my invention are adoptable to this embodiment.

Embodiment 12—Combination type

Instead of using the wrist pen as a writing instrument or a decorative bracelet, it may also be used as a watchband. Particularly, a small watch can be easily attached on the wrist pen. An electric watch, which needs only a little space, can be installed in a section of the barrel.

In this case, the wrist pen is a triple article—a ballpoint pen, a bracelet, and a watchband. Other articles, either decorative or utility, can also be combined with wrist pen, for example, a wrist compass.

Thus, the readers will see that the wrist pen of the invention provides such a highly innovative multi-use, convenient to carry yet economical and complete new writing instrument, that can be used by persons of almost any age, especially the mass students.

While my above description contains many specific embodiments, these should not be construde as limitations on the scope of the invention, but rather as exemplifications of some preferred embodiments thereof. Other variations that contain elements essentially the same or similar to the element of my embodiments, or their legal equivalents, are still on the scope of the invention and thus under the coverage of my claims. For example, instead of using the tubular sections for the pen barrel, they can be made into drum shapes, bead shapes, bug shapes, animal shapes, fruit shapes, plant shapes, heart shapes, eye shapes, and whatever geometrical shapes (oval, triangle, square, pentagon, hexagon, and polygon, etc. in the transverse section). But the hollow center of the sections is preferred to in a round shape, except the half-way telescope type. Furthermore, the sections not only can be a uniform shape, but also a non-uniform shapes. Each section may be different in ornamental design from other sections. Especially, sections in different shapes may construct into common themes, such as dragons, snakes, branches, cartoon characters, etc. Additional items other than the sections themselves, can be combined with the wrist pen.

Accordingly, the scope of the invention should be determined not by the embodiments illustrated, but by the appended claims and their legal equivalents.

What is claimed is:

1. A wrist writing instrument for being conveniently carried on a wrist in a circular form, and for normal writing in a straight form, comprises:

(a) a partially reinforced flexible barrel with a shape reinforced along at least one side thereof by at least one reinforcing member which is flexible laterally but substantially rigid in a longitudinal direction, whereby said partially reinforced flexible barrel has at least one flexible side towards which bending curves said reinforcing member freely and ready to form a circle; and at least one stiff side towards which bending causes to straighten said reinforcing member so as to stiffen said barrel, and (b) stiffening memos to arrest releasably bending of said partially reinforced flexible barrel when writing, comprising structurally at least one bendable side and at least one non-bendable side, said stiffening means being inserted into and pivotally mounted in said partially reinforced flexible barrel, by turning said stiffening means and positioning said bendable side opposite to the direction of said flexible side, said wrist writing instrument as a whole becoming as straight and stiff as a regular pen; and by turning again and positioning said bendable side facing the direction of said flexible side, said wrist writing instrument as a whole becoming flexible again and ready to be bent into a circle as a bracelet, and (c) a flexible ink reservoir with a writing tip being held inside said wrist writing instrument.

2. The wrist writing instrument of claim 1 wherein said partially reinforced flexible barrel further comprises a plurality of rigid tubular sections each having a shape and a matching protrusive and a depressed end, said tubular sections being serially connected and reinforced along one side of said tubular sections by said reinforcing member, therefore, said partially reinforced flexible barrel has at least one flexible side towards which bending makes gaps between adjacent said tubular sections and ready to form a circle; and at least one stiff side towards which bending closes said gaps and squeezes said tubular sections into a straight whole barrel.

3. The wrist writing instrument of claim 1 wherein said partially reinforced flexible barrel is an elongated spiral barrel comprising a plurality of turns, which are in close contact with each other, and at least one reinforcing member, with which said turns are serially connected and reinforced along one side of said spiral barrel so that said flexible side being the side reinforced and said stiff side being other than the side reinforced.

4. The wrist writing instrument of claim 1 wherein said partially reinforced flexible barrel further comprises a plurality of rigid tubular sections with at least one shoulder cut from each end thereof, and two said reinforcing members, on which said tubular sections are serially connected and reinforced along two opposite sides other than the side with said shoulder cut, so as to enable said partially reinforced flexible barrel to be flexible only towards the side with said shoulder cut, and stiff towards the sides reinforced.

5. The wrist writing instrument of claim 1 wherein said partially reinforced flexible barrel further comprises a plurality of rigid beads each with a matching protrusive and a depressed end, said beads being strung on an elongated and partially threaded member which is laterally flexible but substantially rigid in a longitudinal direction, and in combination with said ink reservoir, one of said beads being a nut with which said partially threaded member can be releasably driven to tighten said beads together, stiff and straight as a whole, whereby said partially threaded member is serving as both said reinforcing member and said stiffening means.

6. The wrist writing instrument of claim 1 wherein said partially reinforced flexible barrel further comprises a plurality of rigid tubular sections, and a plurality of reinforcing mechanical joints which are pivotally flexible but substantially rigid in a longitudinal direction, with said mechanical joints, said tubular sections being serially connected and reinforced along one side thereof, so as to enable said partially reinforced flexible barrel bending towards only the side with said mechanical joints.

7. A wrist writing instrument for being conveniently carried on a wrist in a circle form, and for normal writing in a straight form, comprises:

(a) a partially sectionalized barrel which is sectionalized into a plurality of tubular sections, and a non-sectionalized strap, on which said tubular sections are connected along one side of said barrel, said tubular sections, each with a ornamental shape of cross and longitudinal sections, having a matching protrusive and a depressed end for connecting one after another, said non-sectionalized strap being flexible laterally but substantially rigid and strong in a longitudinal direction, whereby said partially sectionalized barrel has a flexible side towards which bending makes gaps between adjacent said tubular sections and curves said non-sectionalized strap to form a circle; and at least one stiff side towards which bending closes said gaps and straightens and stretches said non-sectionalized strap to keep said barrel straight and stiff, and (b) stiffening means to attest releasably bending of said partially sectionalized barrel when writing, having structurally at least one bendable side and at least one non-bendable side, said stiffening means being inserted into and pivotably mounted in said partially sectionalized barrel, by turning said stiffening means and positioning said bendable side opposite to the direction of said flexible side, said wrist writing instrument as a whole becoming as straight and stiff as a regular pen; and by turning again mad positioning said bendable side facing the direction of said flexible side, said wrist writing instrument as a whole becoming flexible again and ready to be bent into a circle as bracelet, and (c) a flexible ink reservoir with a writing tip being held inside said wrist writing instrument.

8. The wrist writing instrument of claim 1 wherein said stiffening means is structurally the same as said partially reinforced flexible barrel, and comprises the same kind of said reinforcing member and said rigid tubular sections, but the diameter of which allows said stiffening means to be inserted into said partially reinforced flexible barrel and pivotally mounted inside thereof, so that said stiffening means herein is bendable towards the side reinforced, and is non-bendable towards the side opposite to the side reinforced, whereby said wrist writing instrument becoming straight and stiff like a regular pen when said bendable side is turned to the opposite direction of said flexible side of said partially reinforced flexible barrel; and becoming flexible again and ready to form a circle when it is turned facing the same direction of said flexible side.

9. The wrist writing instrument of claim 1 wherein said stiffening means is the same as said partially reinforced flexible barrel, and further comprising the same kind of said tubular sections each with at least one said shoulder cut from at least one of the two ends thereof, and a plurality of reinforcing mechanical joints, with which said tubular sections are serially connected and reinforced along two opposite sides other than the side with said shoulder cut, so that, said stiffening means herein has at least one said bendable side that is towards the side with said shoulder cut, and two said non-bendable sides which are towards the sides with said mechanical joints, the diameter of said tubular sections allowing said stiffening means to be inserted into said partially reinforced flexible barrel and pivotally mounted inside thereof, whereby said wrist writing instrument is straight and stiff like a regular pen, when said bendable side is turned to the opposite direction of said flexible side of said partially reinforced flexible barrel; and is flexible when turned facing the same direction of said flexible side.

10. The wrist writing instrument of claim 1 wherein said stiffening means is a stretched spring strap preferably being concurrently an ink reservoir with an original shape of an open circle, therefore, said bendable side of the strap being the side to curve and said non-bendable side being the side to stretch straight, said spring strap, inserted into and pivotally mounted in said partially reinforced flexible barrel, forcing it to become an open circle when said bendable side is turned to the same direction of said flexible side; and to become as straight and stiff as a regular pen when it is turned to the opposite direction of said flexible side.

11. The wrist writing instrument of claim 1 wherein said stiffening means is a tightening bar which is flexible laterally but substantially rigid in a longitudinal direction, with one end fixed on cartridge retainer of the wrist writing instrument opposite to said reinforcing member thereof, and with the other end going through said partially reinforced flexible barrel and leading to outside therefrom, said tightening bar being able to be tightened by pulling against the tension of said reinforcing member, so as to stiffen said writing instrument in the straight form; and by releasing and pushing back said tightening bar, said writing instrument returning to its flexible form.

12. The wrist writing instrument of claim 1 wherein said stiffening means further comprises a plurality of discrete sections with exactly the same length as tubular sections of said partially reinforced flexible barrel, into which said discrete sections are telescoped, by longitudinally pushing said stiffening means back and forth half a distance of said length, the relative position between said tubular sections and said discrete sections changing from a half-way telescoped to a full telescoped position, at said half-way telescoped position, said partially reinforced flexible barrel becoming stiffened and no side being bendable; whereas said full telescoped position restoring flexibility again, whereby instead of turning, pushing back and forth said stiffening means controlling the flexibility.

13. The wrist writing instrument of claim 1 wherein said stiffening means comprises at least one elongated strip, in combination with said ink reservoir, which is flexible to two sides, but substantially stiff towards two edges thereof, inserted into said partially reinforced flexible barrel, with one of two said edges pointing to said reinforcing member thereof, said strip thus stiffening said wrist writing instrument into a straight form for writing; turning said strip facing said reinforcing member, resulting in said flexible form for wearing, whereby turning only 90 degrees of said strip, the two forms of said writing instrument being changed easily.

14. The wrist writing instrument of claim 1 wherein said partially reinforced flexible barrel further comprises a plurality of rigid tubular sections and one said reinforcing member, in combination with said ink reservoir, on which said tubular sections are strung and reinforced, said stiffening means being a twisting type of a toy-brick structure on said tubular sections, with a male end and a female end for engaging with each other, being made on each said tubular sections, by twisting the two extremities of said partially reinforced flexible barrel, all said toy-brick structures with said male and female ends gripping each other respectively, and stiffening said wrist writing instrument for said straight form, and to release the grip, twisting again in reverse direction.

15. The wrist writing instrument of claim 1 wherein said partially reinforced flexible barrel further comprises a plurality of rigid tubular sections, and one said reinforcing member, on which said tubular sections are serially connected and reinforced along one side of said sections, whereby the wrist writing instrument having only one said flexible side and one said stiff side, said stiffening means being a press type of toy-brick structure on said stiff side of said tubular sections, each of which having a male end and a female end for engagement of each other, by bending the writing instrument towards said stiff side so as to press all said male and female ends to click grip with each other, the instrument stiffening into said straight form; by bending the instrument in reverse direction and releasing the grip, the instrument restoring to its flexible form.

16. The wrist writing instrument of claim 1 wherein said partially reinforced flexible barrel further comprises a flexible tube, and three said reinforcing members, with which said flexible tube being reinforced along three sides thereof, whereby the flexibility of said tube is selectively and substantially restricted, except one side that having the reinforcing member in the middle of the three, said stiffening means being a second said flexible tube which is reinforced in the same way and inserted into and pivotally mounted inside the first one, the two sleeved partially reinforced flexible tubes with six said reinforcing members distributed to all the four sides becoming substantially stiffened and thus a straight form of the wrist writing instrument, however, when distributing said six reinforcing members to only three sides and leaving one side free, the two sleeved tubes becoming flexible only to the side opposite to the free side, and thus ready to be bent into said circle form.

17. The wrist writing instrument of claim 1 wherein said partially reinforced flexible barrel and said stiffening means sleeved therein, both are spiral barrels each comprising a plurality of turns, which are in close contact with each order, and one said reinforcing member, on which said turns are serially connected and reinforced along one side thereof, so as to restrict both said barrels flexible only towards the side reinforced, by turning one of the two sleeved said spiral barrels and positioning their two said reinforcing members oppositely, the wrist writing instrument being stiffened for writing; and turning the two said reinforcing members to the same direction, restoring the flexibility.

18. The wrist writing instrument of claim 1 further comprises an item selected from the group consisting of utility and decorative products, said predetermined item being attached to a suitable place ranging from surface to inside of the wrist writing instrument.

19. The wrist writing instrument of claim 18 wherein said item is an electric watch, installed in one of said tubular sections of the wrist writing instrument.

20. The wrist writing instrument of claim 1 further comprises a head-tail connection means, for connecting the two ends of the writing instrument, and forming a close circle, containing a releasable fastening device selected from the group consisting of screws, hooks, bolts, latches, loops, frictional grip structures, a variety of snap fasteners, as well as snap-on structures.

* * * * *